US005769585A

United States Patent [19]

Podolsky

[11] Patent Number: 5,769,585

[45] Date of Patent: Jun. 23, 1998

[54] TOOTHBRUSH WITH TOOTHPASTE

[76] Inventor: Grigory Podolsky, 33-34 77 St. #5H, Jackson Heights, N.Y. 11372

[21] Appl. No.: 434,584

[22] Filed: May 1, 1995

[51] Int. Cl.[6] ..... A46B 11/02

[52] U.S. Cl. ..... 401/146; 401/149; 222/207

[58] Field of Search ..... 401/146, 149, 401/150, 176; 222/207, 209

[56] References Cited

U.S. PATENT DOCUMENTS

| | | | |
|---|---|---|---|
| 4,301,948 | 11/1981 | Czeh | 401/176 X |
| 4,651,904 | 3/1987 | Schuckman | 401/146 X |
| 4,903,867 | 2/1990 | Mettenbrink | 401/146 X |
| 5,104,009 | 4/1992 | Battegazzore | 222/209 |
| 5,346,324 | 9/1994 | Kuo | 401/146 |

FOREIGN PATENT DOCUMENTS

| | | | |
|---|---|---|---|
| 2083142 | 3/1982 | United Kingdom | 401/146 |
| 2161222 | 1/1986 | United Kingdom | 222/207 |

*Primary Examiner*—Steven A. Bratlie

[57] ABSTRACT

A toothbrush is formed with a resilient annular pump having a conical chamber formed by an inner annular surface of the pump and two axially spaced and swingable flap valves inclined with respect to the longitudinal axis of the toothbrush in respective closing positions thereof and with a projection between a piston of the pump an one of the flap valves preventing automatic delivery of the paste into the chamber and creating sufficient pressure for pushing the paste toward the bristles.

8 Claims, 2 Drawing Sheets

Fig.-1
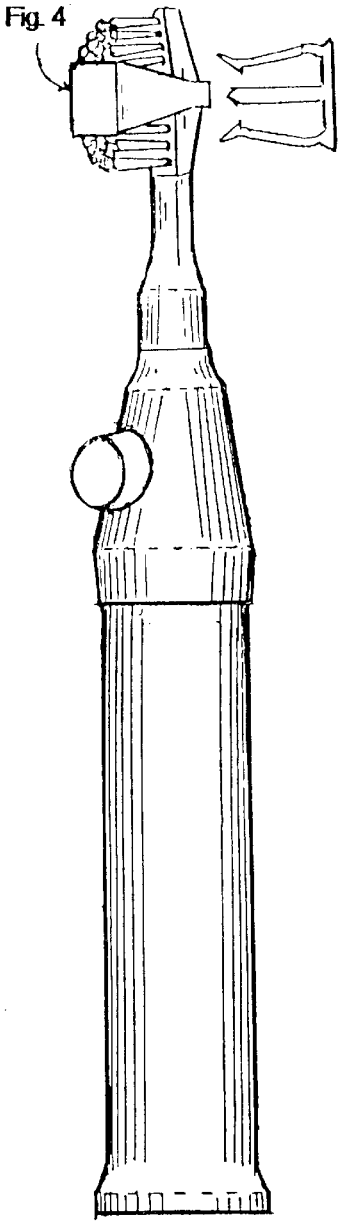
Fig.-4
Fig.-2
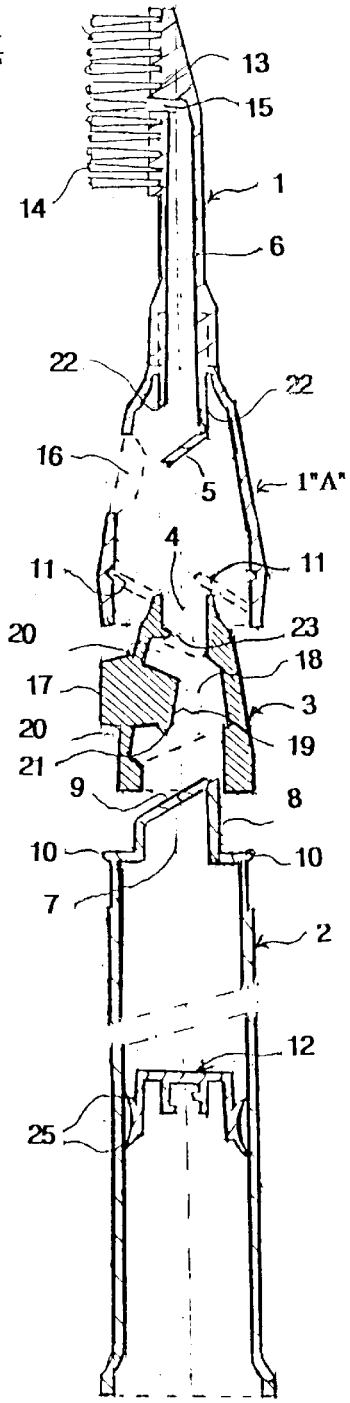
Fig.-3
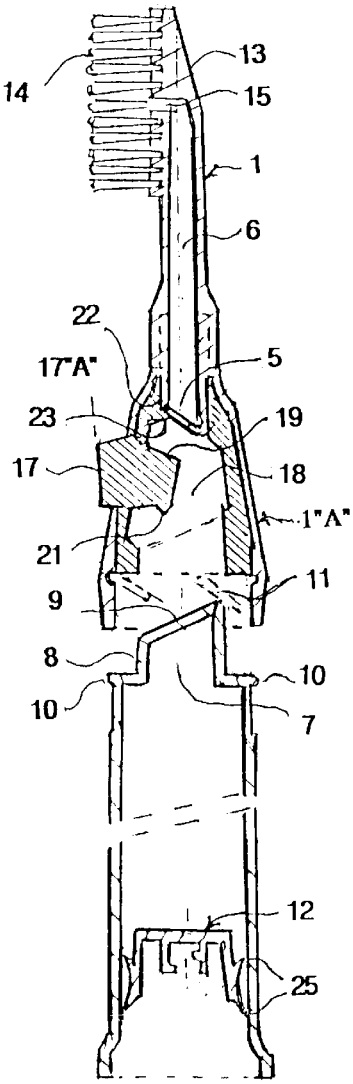
Fig.-5
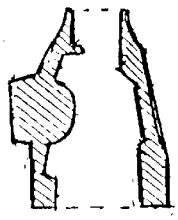

TOOTHBRUSH WITH TOOTHPASTE

FIELD INVENTION

This invention relates to a pate dispenser and more particularly to a toothbrush provided with a flexible, resilient pump and a means for dispensing toothpaste from a paste container to the surface of the bristles.

BACKGROUND OF THE INVENTION

A combination of a toothbrush and a toothpaste container is known but are not widely used because it has a complicated structure and is inconvenient in operation. Such combination also does not take into account the fact that the toothpaste when stored for a long time in the toothbrush without usage becomes dense in the passage of such toothbrushes.

OBJECTS OF THE INVENTION

It is therefore the principle object of the invention to provide a toothbrush overcoming the drawbacks of the prior art.

Still another object of the invention is to provide the toothbrush with detachable container formed with a controllable paste discharge opening.

Yet another object of the invention is to provide the toothbrush with the inner frustoconical chamber providing reliable supply of the paste toward the bristles.

SUMMARY OF THE INVENTION

The toothbrush according to the invention includes an elongated housing having a housing axis and formed with an opening between opposite ends of the housing;

a container mounted detachably on one of the ends of the housing and formed with means coaxial with the housing for supplying a paste along a path toward the other end of the housing and formed with:

a mouth received in the housing and lying in a plane extending at an angle with respect to the axis, and a first flap operatively connected with the mouth and swingable into a closing position about a first axis extending perpendicular to the housing axis to close the mouth;

a resilient hollow pump body mounted in and coaxial with the housing, the body being located downstream from the mouth along the path and being formed with:

a button cooperating with the opening, a piston connected with the button and displaceable arcuately inwardly from an initial position into the path upon applying an external pressure to the button, and membrane means for biasing the piston back in the initial position upon seizing of the external pressure;

a second flap formed along the path and downstream from the pump body and swingable about the second axis parallel to the first axis in a respective closing positions, the first and second flaps converging toward one another in respective closing positions to form a frustoconical chamber in the body;

a longitudinal channel coaxial with the housing and formed with an inlet opening into the chamber and closable by the second flap in the closing position thereof and an outlet;

bristle means for distributing the paste and formed on the other end of the housing and being in a flow communication with the outlet; and nib means between the piston and first flap for swinging the first flap in the closing position after receiving the paste in the chamber from the container and upon displacing the piston into the path.

The pump body is unitarily molded with the piston and the membrane means.

BRIEF DESCRIPTION OF THE DRAWINGS

The above and other objects, features and advantages will become more readily apparent from the following description, references being made to the following accompanying drawing, in which:

FIG. 1 is a longitudinal elevational view of the toothbrush of the invention with a cover;

FIG. 2 is an exploded longitudinal elevational view of the toothbrush;

FIG. 3 is a partly exploded longitudinal elevational view of the toothbrush;

FIG. 4 is a front view of the cover with the juts to fix it on the head of the toothpaste;

FIG. 5 is a side elevational view of the flexible, resilient pump;

SPECIFIC DESCRIPTION

Figure 6:
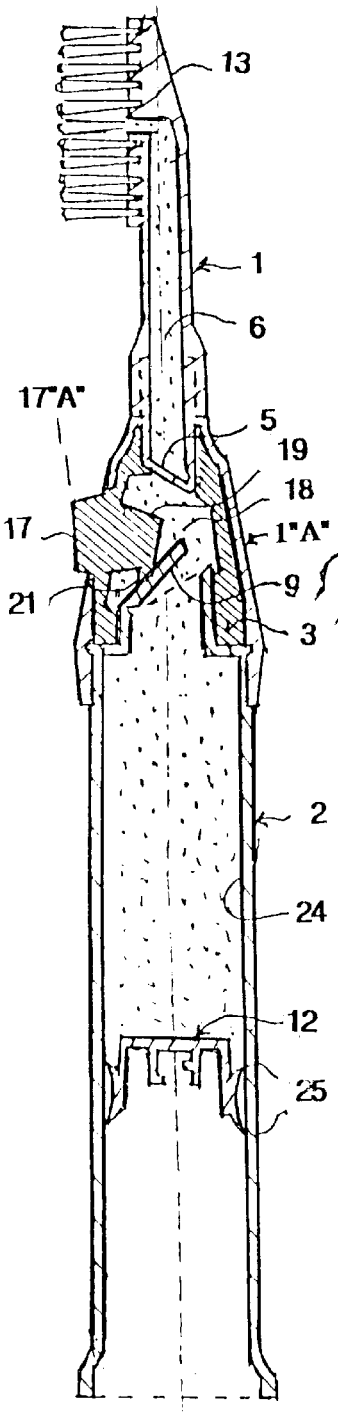
FIG. 6 is a longitudinal sectional view of the toothbrush according to the first embodiment of the invention in the rest position of the piston.

As can be seen in FIGS. 2 through 8 a toothbrush, in accordance with the present invention, has a toothbrushing housing part 1 formed with a head 13 provided with a plurality of bristles 14. Between the bristles in the head 13 there is a discharge aperture 15 of the passage 6 extending axially inwardly toward a flap valve 5.

The part 1 is formed with an annular conical upper housing part 1A and a bottom substantially cylindrical part 1'A which, in turn, is provided with a wide round aperture 16.

The critical part of the present invention is a flexible resilient annular pump 3 formed unitarily with a piston 19 having a respective round push button 17 registered with the opening 16 upon mounting in the housing and displaceable inwardly upon applying an external pressure, and a limited annular membrane 20. The push button 17 has an oblique form 17"A" as can be seen in FIG. 6. The piston 19 has in the lower part a projection 21 which will be described in detail herebelow.

As can be seen in FIGS. 2, 3 an 6–8 the conical part of the part 1 is formed with an axial notch forming a mouth 22 which defines an inlet of the passage 6. The inlet is formed with a flap valve 5.

Figure 7:
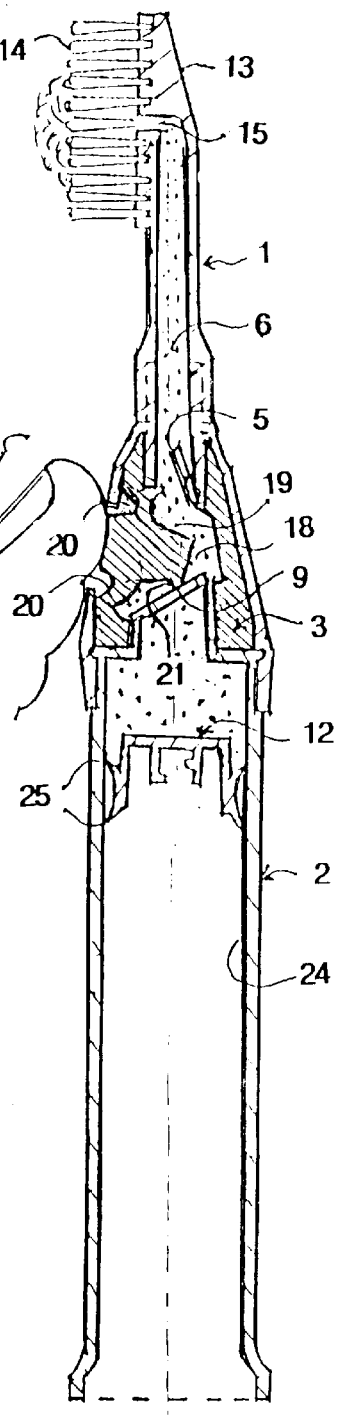
FIG. 7 is a longitudinal elevational view of the second embodiment of the invention in the injecting position.
Figure 8:
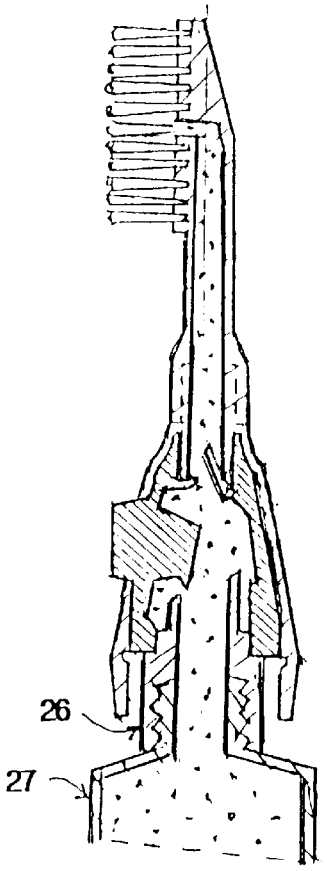
FIG. 8 is a side view of the toothbrush with an elastic tube adapted to supply toothpaste.

The flap valve 5 is a flexible lip swingable upon creating an inner pressure by the paste into an open position as illustrated in FIGS. 6 and 7. In the normal closing position the flap 5 is supported by a projection 23 formed on the pump 3 (FIG. 2). The projection 23 extends radially inwardly from an inner wall of the pump.

The toothpaste container part 2 has a inner cylindrical piston 12 (FIG. 3) slidable along a cylindrical chamber 24 and provided with lips 25 having round edges smoothly sliding along the wall of the chamber 24. The container is a one piece molded body formed with an annular flange 8 forming a mouth of the container, which has level form, is received detachably in the part 1, and with a flexible lip 9 serving as a valve.

As illustrated in FIGS. 2, 3 an 6–8 both the inlet of the passage 6 an the mouth 8 of the container are lying in plane extending at an angle with respect to the longitudinal axis of the toothbrush.

The lower end of the toothbrush part 1 is connected with the upper end of the toothpaste container 2 by outside lugs 10 and inside grooves 11 which have screw-threads shown in FIG. 2.

Once the container 2 is attached to the part 1 the mouth 4 with the flap valve 9 projects inside the pump. Because the mouth 4 and the inlet of the passage 6 are lying in respective planes extending at an angle with respect to the axis, the flap valves 5 and 9, in the respective closing positions, form with the inner surface of the resilient body of the pump a frustoconical chamber 18 illustrated in FIG. 6.

The piston 19 is formed with a nib or formation 21 lying against the flap valve 9 in open position sufficient for intake in the chamber 18 the paste during the negative pressure in the said chamber. Also the nib 21 helps to compulsory close the valve 9 in the initial position of the positive pressure at the moment when the positive pressure is not yet sufficient for closing the valve. Thus the possibility of some part of the paste returning again to the container is prevented. Consequently there is created a considerable compression in chamber 18 making more effective pushing on the toothpaste.

The device operates as follows: As can be seen in FIGS. 6, 7 A user pushes the button 17 the piston 19, removes down due to the oblique angle 17"A" on said button. The nib 21 immediately presses on the valve 9 and forcibly closes it. The discharge flap valve 5 opens and the paste through passage 6 and discharge aperture 15 comes out on the surface of the bristles 14.

Upon withdrawing of the external pressure, the membrane 20 returns the piston 18 and the push button 17 to the initial rest position in such a rapid manner that the movement of the piston creates a "negative pressure" in the chamber 18. The vacuum, thus formed, provides an effective opening of the flap valve 9 bringing, in turn, a supply of new portion of the paste into the chamber 18 from the container 2.

The device is also provided with a metal fixing plate 19 which does not let the piston return in the initial position during the pressure of the toothpaste on it. Since the frustoconical camber 18 is hermetic and because the piston has a great volume the pressure in the chamber is more than sufficient to provide reliable supply of the paste to the bristles.

An important feature of the toothpaste construction is the fact that all passages and flap valves are arranged substantially along the center of the toothbrush as can be seen in FIG. 2.

Figure 9:
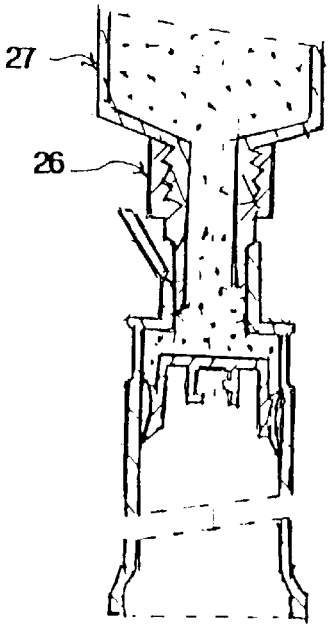
FIG. 9 is a side elevational view of the container an the tube for recharging the container with toothpaste.

The toothpaste container is intended for one as well as multiple usage. For this purpose the toothbrush set includes a universal plug 26 (FIGS. 8, 9) connecting either the container part or toothbrush part with elastic tubes containing different sorts of the toothpaste for passing the latter into the respective part. The process of filling is as follows: After connecting either part with the tube, the resilient tube 27 is pressed upon by a user. As a result, the piston 12 slides to the bottom (FIG. 9) in the initial lower position thereof.

Similarly, if the toothbrush part is being filled out, which happens only once at the start of the usage, the toothpaste is delivered into the chamber 18 from the tube 27 and then through the passage 6 comes out on the surface of the bristles.

The invention provides a toothbrush with a flexible, resilient pump having a push button which is convenient for the user. The elastic push button essentially reduces the distance between the bristles and the push button without preventing the brushing of the teeth. The push button together with the flexible resilient pump forms a compact unit.

Finally, the set also includes a cover shown in FIG. 4 which prevents the contact of air with the toothpaste when the toothbrush is not in use preventing thereby the toothpaste from drying up in the narrow passage.

I claim:

1. A rechargeable dispensing device comprising:

an elongated housing having a housing axis and formed with an opening between opposite ends of the housing;

a container mounted detachably on one of the ends of the housing and formed with means coaxial with said housing for supplying a paste along a path toward the other end of the housing and formed with:

a mouth received in said housing and lying in a plane extending at an angle with respect to said axis, and a first flap operatively connected with said mouth and swingable from an open position into a closing position about a first axis to close the mouth, said first axis extending perpendicular to the housing axis;

a resilient hollow pump body mounted in and coaxial with said housing, said resilient hollow pump body being located downstream from said mouth along the path and being formed with:

a button registered with said opening, a piston connected with said button and displaceable arcuately inwardly from an initial position which corresponds to said open position of the first flap into said path upon applying an external pressure to the button, and membrane means for biasing said piston back in the initial position upon withdrawing the external pressure;

a second flap formed along the path and downstream from said resilient hollow pump body and swingable about the second axis parallel to the first axis into a respective closing position, said first and second flaps converging toward one another in respective closing positions to form a chamber in said resilient hollow pump body;

a longitudinal channel coaxial with said housing and formed with an inlet opening into said chamber and closable by said second flap in the closing position thereof and an outlet, said mouth and said inlet opening being centered on said housing axis;

bristle means for distributing the paste and formed on the other end of the housing and being in a flow communication with said outlet; and stop means between the piston and first flap for swinging the first flap into the respective closing position after receiving the paste in the chamber from the container and upon displacing the piston into the path, said stop means being in contact with the first flap in the open position thereof.

2. The rechargeable device defined in claim 1 wherein said resilient hollow pump body is made in one piece.

3. The rechargeable device defined in claim 1 wherein said chamber is spaced substantially equidistantly from said opposite ends of the housing.

4. The rechargeable device defined in claim 1 wherein said stop means includes a projection formed on said piston.

5. The rechargeable device defined in claim 1 wherein said button is formed with a surface projecting through said opening and extending at another angle with respect to said longitudinal axis.

6. The rechargeable device defined in claim 1 wherein said container is formed with means for receiving a new supply of the paste.

7. The rechargeable device defined in claim 1 wherein said container is formed with a plug formed with a thread for connecting with said housing having means for receiving said thread.

8. The rechargeable device defined in claim 1 wherein said inlet of the channel is formed with a flange extending axially into said chamber and supporting the second flap in the respective closing position.

* * * * *